United States Patent [19]

Okada et al.

[11] 4,440,700

[45] Apr. 3, 1984

[54] PROCESS FOR COLLECTING CENTRIFUGALLY EJECTED FILAMENTS

[75] Inventors: Tokio Okada; Shigezo Kojima; Haruhisa Tani; Kazuhiko Kurihara; Hiroshi Yazawa, all of Tokyo, Japan

[73] Assignee: Polymer Processing Research Institute Ltd., Tokyo, Japan

[21] Appl. No.: 372,190

[22] Filed: Apr. 26, 1982

[30] Foreign Application Priority Data

Apr. 28, 1981 [JP] Japan ..... 56-64854
May 26, 1981 [JP] Japan ..... 56-79767

[51] Int. Cl.[3] ..... B29C 6/00

[52] U.S. Cl. ..... 264/8; 19/305; 264/11; 264/103; 264/164; 264/180

[58] Field of Search ..... 264/8, 12, 11, 103, 264/164, 180, 181; 19/305

[56] References Cited

U.S. PATENT DOCUMENTS

| | | | |
|---|---|---|---|
| 1,500,932 | 7/1924 | Hooper | 264/8 |
| 1,500,933 | 7/1924 | Hooper | 264/8 |
| 2,439,772 | 4/1948 | Gow | 264/8 |
| 2,816,826 | 12/1957 | Brennan | 264/12 |
| 3,032,813 | 5/1962 | Stalego | 65/10.1 |
| 3,250,602 | 5/1966 | Stalego | 65/9 |
| 3,357,807 | 12/1967 | Stalego | 65/6 |
| 3,738,884 | 6/1973 | Soehugen | 264/164 |
| 3,860,370 | 1/1975 | Kuerfoes et al. | 264/164 |
| 4,143,196 | 3/1979 | Simm et al. | 264/8 |

FOREIGN PATENT DOCUMENTS

| | | | |
|---|---|---|---|
| 48-73569 | 10/1973 | Japan | 264/8 |
| 50-116772 | 9/1975 | Japan | 264/8 |
| 51-17376 | 2/1976 | Japan | 264/8 |
| 51-9067 | 3/1976 | Japan | 264/8 |
| 53-35074 | 4/1978 | Japan | 264/8 |
| 55-36331 | 3/1980 | Japan | 264/8 |
| 902795 | 8/1962 | United Kingdom | 264/8 |

*Primary Examiner*—Jay H. Woo
*Attorney, Agent, or Firm*—Fred Philpitt

[57] ABSTRACT

A process for collecting continuous polymer filaments centrifugally ejected from the spinning nozzles of a spinning head rotating at a high velocity is provided wherein the ejected filaments are caught by the surface of an annular form, flowing down liquid or by an annular wall surface wetted by a liquid flowing down thereon, spaced apart from and surrounding the spinning head and concentrically opposed to the head; then moved downwards from the location where the filaments are caught, by the flowing down liquid and if necessary, together with two or more guides; and dropped on a belt moving below the spinning head in the lateral direction and taken up in the form of multifilaments or dropped on the belt in the form of an ellipse long in the width direction of the belt and after adhering selvage materials to both the side end parts of the filaments, taken up in the form of a weft web of the ejected filaments.

12 Claims, 4 Drawing Figures

PROCESS FOR COLLECTING CENTRIFUGALLY EJECTED FILAMENTS

BACKGROUND OF THE INVENTION

1. Field of the Invention

This invention relates to a process for collecting continuous organic polymer filaments centrifugally ejected from the spinning nozzles of a spinning head rotating at a high velocity. More particularly it relates to a process for collecting the above filaments by quenching or rapidly coagulating them with an annular liquid surface around the spinning head to collect them in the form of multifilament yarns or a web of ejected filaments arranged in parallel in the weft direction.

2. Description of the Prior Art

For collecting centrifugally ejected filaments, various processes have heretofore been proposed such as those of Japanese patent application laid-open Nos. Sho 48-73,569 (1973), Sho 50-116,772 (1975), Sho 51-17376 (1976), etc. However, any of them is directed to a process for collecting the ejected filaments, whether they are continuous or discontinuous, in the form of a mat-like non-woven fabric. Further as other examples, processes for glass fibers have been proposed such as those disclosed in U.S. Pat. Nos. 3,032,813; 3,250,602; 3,357,807; etc. Although the above processes include a process for producing multifilament yarns, no particular consideration has been taken as to cooling of the ejected filaments, and contrarily there have been proposed even processes of heating the filaments with hot air or the like to thereby soften and stretch them into fine filaments. Further these processes include a process for further making a glass fiber mat or pack, or a mat reinforced by warp fibers, of the ejected glass filaments. However, none of the above examples are suggestive of a process described above in the field of the invention, that is, a process for collecting centrifugally ejected, continuous organic polymer filaments by quenching or rapidly coagulating them by an annular liquid surface around the spinning head to collect them in the form of multifilament yarns or a web of ejected filaments arranged in parallel in the weft direction.

In the case where glass fibers are produced from molten glass, the spinning temperature is very high, and in the case of centrifugal spinning, too, fibers are rapidly cooled and solidified. Thus, no particular cooling, of course, is necessary. However, in the case where organic polymer filaments are prepared according to centrifugal spinning process, the passageway of filaments ejected from the spinning nozzles till they are collected is so short unlike the case of usual melt-spinning processes that unless a particular means is taken, there may occur not only a fear of an interfilamentary cohesion or agglutination, but a fear that the molecular orientation of ejected filaments at the time of spinning is relaxed.

Further as to a process for producing a web of filaments arranged in parallel as wefts, from the ejected filaments (this web will be hereinafter abbreviated to "weft web of ejected filaments"), there are prior inventions made by us: Japanese patent No. 835,956 (Japanese patent publication No. Sho 51-9067/1976) (entitled: Process for continuously fixing arrangement of yarns); Japanese patent application laid-open No. Sho 53-35,074 (entitled: Process for producing a web of filaments arranged in parallel as wefts from ejected filaments according to high velocity, centrifugal spinning process); and Japanese patent application laid-open No. Sho 55-36331 (entitled: Process for producing a weft web of ejected filaments according to centrifugal spinning). Among these processes, there is a process of cooling the ejected filaments with water. We found, however, as a result of our studies on the ejected filaments produced by the above processes, that the thickness of the ejected filaments at the location where one ejected polymer filament, not yet solidified, is circumferentially approaching one end in the width direction, of the warp yarn or one selvage of the tape at the time of spinning is different from the thickness of the filaments at the location where one solidifying polymer filament has just been caught by the warp yarn or the tape and the resulting polymer filament is going to leave another end of the warp yarn or another selvage of the tape; namely the filament at the former location is thicker and the filament at the latter location is thinner than the average filament thickness; in addition, knobs sometimes form at the former location; thus the thickness of the filaments becomes non-uniform. Accordingly, in order to obtain ejected filaments having a uniform thickness, it is necessary to avoid the contact of the filaments with any solid material before they are sufficiently cooled and solidified. We found as a result of further studies that when the ejected filaments are caught only by a liquid surface and at the same time quenched or rapidly coagulated, followed by moving the filaments from the location where they are caught, then it is possible to obtain the filaments in a uniform thickness.

Further we found as a result of additional studies that if slight faults are allowable in the ejected filaments in the above case, a process is effective as a reliable process for collecting the filaments, wherein at least one adhesive warp selvage material which is provided on an annular form liquid surface prepared concentrically around the spinning head, and moved in the longitudinal direction, catches the ejected filaments at the same time when the filaments are caught by the surface of the liquid, and the filaments are successively moved from the location(s) where they have been caught, guided by the movement of the warp selvage material(s) and collected. However, even according to the above process, it is impossible to collect the ejected filaments in the form of continuous multifilaments.

SUMMARY OF THE INVENTION

The present invention has the following aspects:

(1) In a process for collecting continuous polymer filaments centrifugally ejected from the spinning nozzles of a spinning head rotating at a high velocity, the improvement which comprises catching the ejected filaments by the surface of an annular form liquid spaced apart from and surrounding the spinning head and concentrically opposed to the head; successively moving the filaments from the location where the filaments are caught; and collecting them.

(2) A process according to the above item (1) wherein said liquid surface flows down and the ejected filaments are successively moved downwards from the location where the filaments are caught, by the flowing down liquid.

(3) A process according to the above item (1) wherein the ejected filaments caught by the liquid surface are moved downwards by being transferred onto two or more guides which move downwards while passing through the inside of the liquid, at a place just below the location where the filaments are caught, by means of suction.

(4) A process according to the above item (1) wherein the ejected filaments caught by the liquid surface are successively dropped onto the surface of a belt running below the spinning head in the lateral direction.

(5) A process according to the above item (1) wherein at least one adhesive warp selvage material which is moved in the longitudinal direction is provided so as to pass through the inside of the liquid very close to and in parallel to the liquid surface to thereby catch the ejected filaments not only by the liquid surface, but at the same time by said at least one warp selvage material, followed by successively moving the ejected filaments by the guidance of the warp selvage material, from the location where the filaments are caught, toward a location where they are taken up.

(6) In a process for collecting continuous polymer filaments centrifugally ejected from the spinning nozzles of a spinning head rotating at a high velocity, the improvement which comprises catching the ejected filaments by the surface of an annular form liquid, spaced apart from and surrounding the spinning head and concentrically opposed to the head; successively moving the filaments downwards from the location where the filaments are caught; successively dropping the filaments onto the surface of a belt running below the spinning head in the lateral direction; applying a selvage material onto both the side end parts of the dropped ejected filaments; and taking up the filaments in the form of a web of ejected filaments arranged in parallel as wefts.

(7) A process according to the above item (6) wherein said liquid surface is a flowing down liquid surface and the ejected filaments are successively moved downwards by the flowing down liquid,from the location where the filaments are caught.

(8) A process according to the above item (6) wherein the ejected filaments caught by the liquid surface are moved downwards by being transferred onto two or more guides which move downwards while passing through the inside of the liquid, at a place just below the location where the filaments are caught, by means of suction.

BRIEF DESCRIPTION OF THE DRAWINGS

FIG. 4 shows a cross-sectional view projected on a vertical plane passing through the warp selvage materials, of an apparatus under operation according to an embodiment of the process of the present invention.

FIG. 5 shows a horizontally cross-sectional view of the part where centrifugal spinning is carried out according to an embodiment of the process of the present invention.

DETAILED DESCRIPTION OF THE INVENTION

Figure 1:
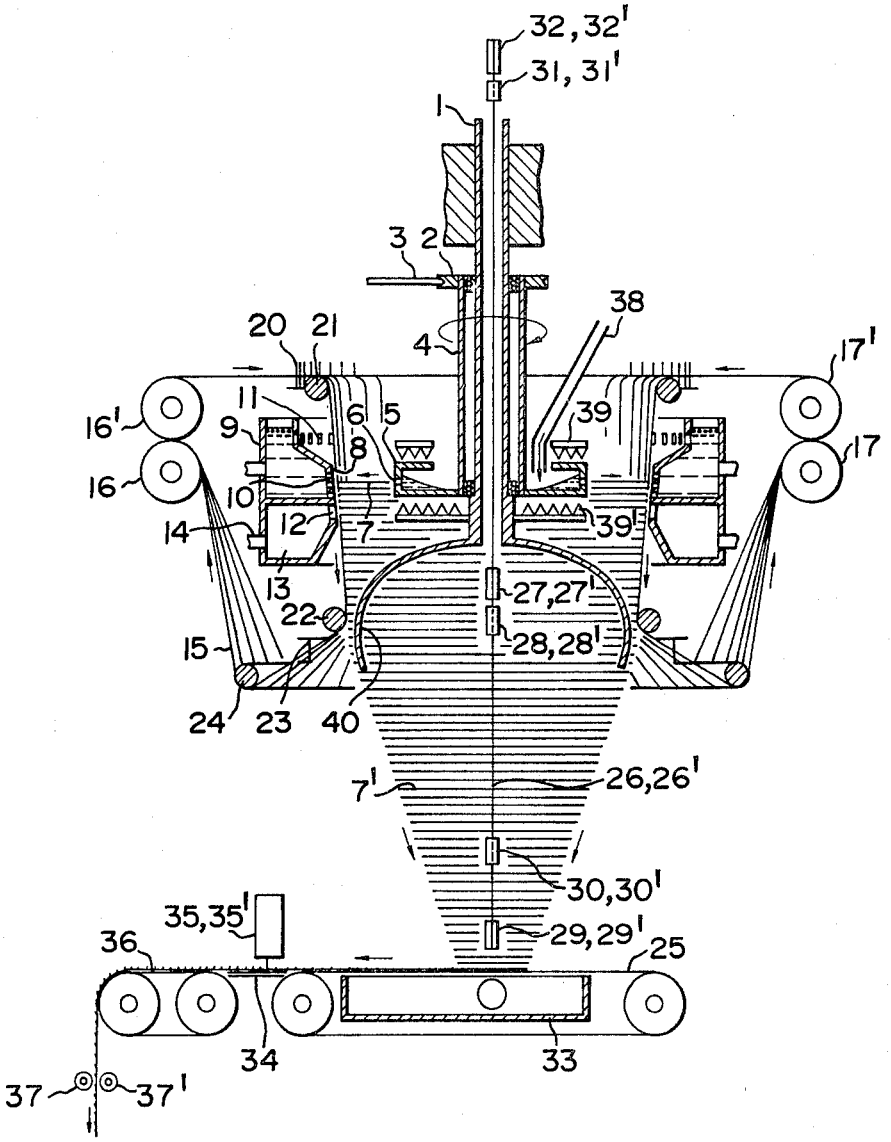
FIG. 1 shows a vertical cross-sectional view of an apparatus under operation according to an embodiment of the process of the present invention, taken along the center line of a circulating belt running below the spinning head for ejected filaments in the lateral direction.

The polymer to be ejected from the spinning head in the process of the present invention mainly comprises organic high molecular weight compounds having a filament-forming property and is fed in molten state or in the form of a concentrated dope to the spinning head.

If the centrifugal effect brought about by the rotation of the spinning head rotating at a high velocity is indicated by the ratio of the generated centrifugal force to gravity and is termed "Z", the minimal value of the centrifugal effect Z generally employed in the centrifugal spinning processes is about 100. The centrifugal force itself is proportional to the weight of the polymer to be spun per unit volume and the rotating radius of the spinning head, and also proportional to the square of the rotation number of the head. The value of Z is related to the extrusion pressure of the polymer and hence to the quantity of the polymer extruded. It is easy to bring the Z value over 10,000. The spinning velocity is proportional to the radius of the catching surface and the rotation number of the spinning head, and if no slip of the ejected filaments occurs after they have been caught, the spinning velocity is determined by the circumferential length of the catching surface, and also the rotation number of the spinning head. Thus even when a small type spinning head is employed, the spinning velocity is yet determined by the circumferential length of the liquid surface by which the ejected filaments are caught, concentrically opposed to and surrounding the spinning head at a distance of about 50 to 100 mm, and also the rotation number of the head; hence even when a small slip of the caught filaments in the lateral direction is taken into account, the spinning velocity can be easily brought to 5,000 m/min. or higher.

In the case of a relatively low velocity spinning, the spun filaments are caught in an insufficiently oriented state or without any orientation. Particularly when thick filaments are spun, they reach the catching surface in an insufficiently cooled and incompletely solidified state. In such a case, if cooling and solidification of the filaments are incomplete at the time of being caught, interfilamentary cohesion or agglutination is not avoided, and a stabilized operation is impossible, whereas in the present invention, since the ejected filaments are caught by the liquid surface, cooling and solidification of the filaments are carried out completely and in a very short time through their contact with the liquid.

In the case of a high velocity spinning, the degree of molecular orientation of filaments is generally not only more improved with the increase in the spinning velocity, but the filaments are considerably cooled before they reach the catching surface, as compared with the above case where thick filaments are spun, as described later. Such cooling, however, cannot be yet regarded as complete. Even if cooling is somewhat insufficient, it can be said that the adhesive property of the filament surface has been reduced by the improvement in the degree of molecular orientation. According to the process of the present invention, even such filaments are completely cooled and solidified by the catching liquid surface; hence the molecular orientation is no longer relaxed.

In the case of melt-spinning of nylons, polyesters, polyolefins, etc., it is well known that the higher the spinning velocity, the greater the effect of molecular orientation, whereby the physical properties expressed by strength and elongation are improved. For example, in the case of nylons or polyesters, it is known that at a spinning velocity of about 1,000 m/min., after-stretching to additional about 4 times is necessary, whereas at a spinning velocity of about 2,500 m/min., it is possible to obtain filaments having sufficient strengths by after-stretching to about 1.6 to 1.8 times. Further it is known that in the case of polyester spinning at a spinning velocity of 5,200 yd/min. or higher, it is possible to obtain highly oriented and highly crystalline filaments having a good stability in hot water without any after-stretching (see Japanese patent publication No. Sho 35-3,104 (1960)).

By way of the above various examples, it can be seen that high velicity spinning is effective for producing filaments economically. However, particularly in the case of spinning velocities exceeding 3,000 m/min., it is not easy to collect the filaments, and the mechanism to take up them is not economical; thus the spinning velocities have been practically restricted to lower ones in this respect.

In the case of centrifugal spinning processes, if the spinning velocity is relatively low i.e. up to about 2,000 m/min., it is possible to take up the filaments in conventional manner, but if the spinning velocity exceeds 3,000 m/min., how to take up filaments running at such high velocities raises a problem. The process of the present invention is particularly directed to such a problem.

In the practice of the process of the present invention, in order to ensure the catching of the ejected filaments not in the form of fluffy candy-like fibers, but in the form of continuous filaments, and also in order to prevent the ejected filaments from being caught in an overlapped state, a device is necessary for successively shifting the ejected filaments from the location on the liquid surface where they are caught, toward the direction perpendicular to the location, as they are caught, and also since the higher the rotating velocity of the spinning head, the greater a fear that the ejected filaments are further dragged from the location where they have been caught, toward the rotating direction of the spinning head, a device is necessary for preventing or minimizing the effect of this phenomenon.

The liquid surface and the above devices employed in the process of the present invention will be described below in detail. As for the form of the liquid surface, a short annular liquid surface concentrically opposed to the spinning head may be generally employed. However, since the ejected filaments spun at a high temperature shrink when caught and quenched with the liquid, and they are somewhat dragged toward the rotating direction of the spinning head, the diameter of the ejected filaments tends to be reduced at the time of catching. If this is taken into account, a funnel-like liquid surface so devised that the diameter of the surface is reduced from the upper surface toward the lower may be rather preferable. As a liquid surface for such purpose, a liquid surface on the surface of a short annular or funnel-like, fixed wall to be uniformly wetted by the liquid over the total surface thereof may be the most stabilized liquid surface. As the structure of such a wall surface, such a structure may be most often employed that the wall surface having the above form is covered by a hydrophilic cloth and able to be uniformly and sufficiently wetted over the total surface thereof, and if necessary, the liquid is caused to flow down on the surface thereof. In this case, if the hydrophylic cloth is absent, the liquid on the wall surface is liable to deviate and form an uneven flow to cause a non-uniform cooling; thus it is rather preferable to employ the upper portion of an unconfined, free-flowing and uninterrupted column of a liquid flowing down off an annular sharp knife edge on the inside circumference of an annular liquid retainer surrounding the spinning head.

For feeding the liquid, either the liquid may be fed at the upper end of the wall surface or may be fed to the back of the cloth as described above through which the liquid oozes out from its back surface onto its surface, the oozed liquid then flowing down along the surface. Further, a metal surface having numberless fine holes or a surface of wire gauze having fine meshes, both through which the liquid oozes out from its back surface onto its surface, the oozed liquid then flowing down along the surface may also be suitable. If the amount of the liquid flowing down on such wall surfaces is adequately increased, it is possible to cause the ejected filaments caught by the liquid surface to successively flow down and move downwards as they are caught. This means may also be employed as a means for preventing the ejected filaments from being caught in an overlapped state.

Even if the selvage materials to be inserted into the inside of the liquid on which surface portions of the ejected filaments are caught and adhered onto the materials are not employed, the ejected filaments once caught on the liquid surface are not readily separated from the liquid surface due to the surface tension of the liquid, and are only dragged slightly in the lateral direction, because they are subjected to a frictional resistance against the liquid surface; hence the ejected filaments are no longer separated from the liquid surface to form a fluffy candy-like state. However, in order to make the catching surer, a suction chamber having slit-like suction holes or reticular suction holes may be provided below the location where the ejected filaments are caught, at a distance very close thereto. When the flowing down liquid is sucked into the suction chamber together with the ambient air, the ejected filaments themselves are also sucked and thereby the chance of the ejected filaments being dragged in the lateral direction can be minimized. Further such a suction chamber also greatly serves to prevent the ejected filaments from being disturbed by the ambient air disturbed by the high velocity rotation of the spinning head during their flying till they reach the catching liquid surface; hence a regular catching of the ejected filaments is also possible.

On the other hand, in the absence of the above selvage materials inserted, the above suction hinders the ejected filaments from further moving downwards; hence a device for preventing this hindrance effect is needed. As an example of such a device, a means may be employed wherein the ejected filaments are transferred onto two or more guides such as those of nylon tire cords passing through the inside of the liquid just close to the catching liquid surface and moving downwards, by the effect of suction, and are then dropped onto the surface of a layer such as a belt running below the suction chamber in the lateral direction. In this case, as to a method for introducing the guides so as to obtain uniform ejected filaments, it is necessary to keep the guides not to be exposed out of the catching liquid surface. As examples of the methods therefor, the guides may be introduced at the upper part of the wall surface and descend along the wall surface through the inside of the liquid just close to the liquid surface, or may be introduced through the wall on its midway and then go out into the liquid on the surface of the wall on the midway of the wall. Alternatively, the guides may be introduced into the liquid either at a location where the flowing down liquid has left the lowermost end of the wall surface, or just below the sharp edge in the case of the above unconfined, free flowing of a liquid. In any of these cases, the guides must not appear on the liquid surface at any location where the ejected filaments are caught by the liquid surface, i.e. direct contact of the guides with the ejected filaments without the medium of the liquid surface must be avoided, because such direct contact yields thick parts and fine parts and also knobs on the ejected filaments, as mentioned above.

All of these two or more guides should have uniform speed, and it is preferred that the speed be equal to or faster than the flowing down speed of the liquid giving the liquid surface.

Next, when the ejected filaments are conveyed downwards by the two or more guides and dropped onto a belt surface running below the spinning head in the lateral direction, it is not always necessary that the filaments keep a circular form, but if they are deformed to be an ellipse having its long axis in the direction of the selvage ends, dropped on the belt surface and stacked on it in the form of a band to be carried away, this is rather convenient for taking up them as mentioned later. As a method of having the ejected filaments take such an elliptic form, the following method is recommendable: While the ejected filaments are moving downwards by the medium of the flowing down liquid flow or the two or more guides, guide bars different from the above guides or separate guide yarns or belts which circulate or merely move one way may be additionally applied to the ejected filaments from the inside thereof, and the annular form of the ejected filaments are extended toward the lateral direction of the belt running therebelow. The inside guides, in cooperation with the outside means such as the two or more guides or the flowing down liquid flow, extend the filaments into the form of a long-ellipse, followed by dropping them onto the belt. In this case, the guides applied from the inside may be provided in a pair at symmetrical locations and run at a velocity same as or faster than that of the outside two or more guides. In some case, the yarn or belt guides applied from the inside may be not circulated, but moved at the same velocity as that of the belt running therebelow, and then stacked in the form of a band in which the yarn or belt guides are enclosed as they are, to obtain a product having selvage materials therein.

The appropriate relationship between the location where the ejected filaments are caught and the location where they are sucked, varies depending on the operating conditions such as the spinning velocity i.e. the rotation velocity of the spinning head, the thickness of the ejected filaments, etc. even if the apparatus is same; hence it is preferred that the location of the apparatus surrounding the spinning head, where the ejected filaments are caught, can be adjusted somewhat downwards or upwards, relative to the spinning head.

The ejected filaments are dropped from the liquid surface on which they have been caught, onto a belt surface running therebelow in the lateral direction. The velocity of the running belt surface can be optionally determined, and it may be about one several tenth to one several hundredth of the spinning velocity; however high the spinning velocity may be, the operation is converted to the running velocity of the belt. Thus, the operation dealing with the filaments becomes easy, and the filaments are continuously carried on the running belt surface in a state where the filaments are stacked in the form of a band.

Further a case will be described below where the adhesive selvage materials are inserted into the inside of the liquid to ensure the catching, even at the cost of small faults in the filaments. In this case, consideration should be taken generally so as to prevent the adhering surface of the selvage materials, from being wetted with the cooling liquid. This improves adhesion of the ejected filaments to the selvage materials. Further, particularly when it is necessary to preheat the selvage materials and thereby improve their adhesive properties in advance, or for example, in the case of high velocity spinning where selvage materials applied with a hot-melt adhesive are used, it is impossible to preheat the adhesion parts unless contact with the cooling liquid is prevented.

Next the warp selvage materials will be described below. As the selvage materials, two or more yarns, slit tapes, etc. having a hot-melt adhesive sized thereon are generally used. As the sizing agent used, the above adhesive may be generally used, and besides, quick-drying or quick-curing sizing agents may also be used depending on the uses of the product i.e. the weft web of ejected filaments. In any case, the most suitable sizing agents are used depending on the kinds of the raw material polymers for the ejected filaments. Sizing agents to be most commonly used are hot-melt sizing agents composed mainly of ethylene-vinyl acetate copolymers, and as other kinds of hot-melt sizing agents, those of polyesters, polyamides and polyurethanes may also be used. They are adequately selected from among commercially available products depending on the uses. Further, in some case, those consisting of the same polymer as that of the ejected filaments and having a low molecular weight or a low melting point may also be used.

As to the locations where the warp selvage materials are arranged on the catching surface, those most frequently employed are two symmetrical locations relative to the center line of the rotating shaft of the spinning head i.e. two locations corresponding to both the ends of the diameter of the catching surface. The ejected filaments caught on the catching surface in an annular form may be continuously extended toward right and left, by the guidance of right and left warp selvage yarns arranged at the above locations, and ultimately taken up in the form of a flat two-ply sheet. Alternatively, the ejected filaments on the catching surface in an annular form may be cut open at both the right and left warp selvage materials by dividing the respective selvage materials into two, and developed and taken up as two flat webs. As another alternative, the selvage materials are further added; for example, it is possible to space 4 sets of the warp selvage materials at equal intervals and cut open the ejected filaments at the respective materials by dividing the respective selvage materials into two, and take up the ejected filaments in the form of four flat webs, each having one selvage material at the respective selvage ends.

As to the direction in which the weft web of ejected filaments is taken up, generally the rotating shaft of the spinning head is vertically arranged and the location where the ejected filaments are caught is horizontally provided, and the weft webs of ejected filaments are taken up usually downwards. In some case, however, upward take-up may be more advantageous.

Next, a method of collecting the ejected filaments in the form of multifilament yarns will be described below. In this case, warp selvage materials or the like are not used under the surface where the ejected filaments are caught. The filament number of multifilaments consisting of the ejected filaments, obtained in this case is equal to the number of spinning nozzles around the spinning head. However, it is difficult to pick up filaments corresponding to the number of the spinning nozzles from the stack of the ejected filaments in the form of a band as mentioned above; however, if distribution of the spinning nozzles around the spinning head is uniform except on a small part where no nozzle is present, the filaments can be picked up noting the vacant space which appears when the end of filaments is pulled up corresponding to this part, so the above difficulty in pick-up is overcome i.e. the pick-up becomes easy. Further, since the spinning head rotates at a high velocity, it is preferable that the distribution of the spinning nozzles be symmetrical; hence there should be at least two small parts where no nozzle is present, on the spinning head, symmetrically to the rotating axis. Alternatively, spinnerettes having a necessary number of spinning nozzles may be arranged at equal intervals. Thus it is possible to easily pick up the ejected filaments corresponding to the number of the spinning nozzles around the spinning head, from the stack of the above ejected filaments in the form of a band.

Now, a method of taking up multifilament yarns from the ejected filaments will be described below. An adhesive tape, a hot melt resin-applied tape or the like is adhered under press onto both the surface and back surface of the band of the ejected filaments on the above moving belt, straightly across the width, for each definite time or each definite length or weight of the filaments. Then the band is cut off along the center line of the adhered tape straightly across their width together with the tape, and each band of the ejected filaments are taken into separate cans, respectively. The respective ejected filaments are drawn out by the guidance of the above tapes, starting from the rear end thereof, and filaments corresponding to the number of the spinning nozzles are picked up noting the rift of the array of the ejected filaments as a mark. The picked up filaments are then wound up on a usual bobbin or the like. The ejected filaments thus wound up have weak twist and are used as a raw material for general purpose.

If the multifilament yarns thus obtained are subjected to after-stretching in a stretching ratio selected according to the spinning velocity of the ejected filaments and if necessary, further subjected to heat set treatment, then multifilament yarns having a high heat-stability and superior physical properties are obtained.

Next, a method of collecting the ejected filaments in the form of a weft web of ejected filaments will be described below. In this case, the spinning nozzles of the spinning head may all be arranged at equal intervals.

For collecting the ejected filaments in the form of a weft web of ejected filaments except for the case where selvage materials have already been adhered thereto, a selvage material is first adhered onto the ejected filaments in the form of a band on the above surface running in the lateral direction below the spinning head. As the selvage material, a tape, a band consisting of a plurality of yarns or the like, having an adhesive, preferably a curable soft adhesive such as a curable acrylic ester adhesive applied thereonto may be used. Such an adhesive is adhered to the ejected filaments in the form of a band, along both their selvage ends, followed by curing. Alternatively, a tape, a band or the like having a simple hot-melt adhesive applied thereonto is similarly adhered or both the selvage ends are machine-sewn, respectively. Thus a product having selvage materials fixed onto both the right and left selvage ends of the ejected filaments in the form of a band is obtained. Usually both the selvage materials are extended outwards in the right and left directions to obtain a weft web of ejected filaments wherein all of the ejected filaments are nearly straight. In this case the ejected filaments are not always necessary to be extended till they are straight across the web. For example, the ejected filaments themselves may be fixed with an adhesive to directly obtain a kind of non-woven fabric. Thus the manner in which the ejected filaments are extended in the lateral direction can be selected according to the uses of the product.

In this case, the weight per unit area of the resulting weft web of ejected filaments can be determined by the amount per unit time of the filaments ejected from the spinning head at the time when they are placed on the surface of a belt running in the lateral direction, in the form of a band; the width of the stacked filaments or the width of the extended filaments on the surface running therebelow; and the moving velocity of the surface.

The resulting weft web of ejected filaments is, in most cases, subjected to after-stretching in the lateral direction i.e. in the length direction of the filaments in a stretching ratio selected according to the spinning velocity of the ejected filaments, while the filaments are gripped at both the selvage materials fixed thereonto, whereby a product having further improved physical properties is obtained. If necessary, heat set treatment is applied to improve its heat stability.

The weft web of ejected filaments is difficult to wind up, as it is; the characteristics of the weft web may be displayed when combined with other material having a warp function; hence it is recommendable to treat it as follows: Subsequent to the production of the web, it is sent to a lamination process and combined with a web of warped yarns, a web of filament tow which has been broadened into a uniform thickness, or the like web, and an adhesive is sprayed onto or impregrated in the resulting laminate, followed by heat press bonding to obtain a product of cross-lamination. Alternatively the above web may be used as a reinforcing material in the weft direction by laminating it directly onto a non-woven fabric deficient in the strength in the weft direction. Alternatively the weft web of ejected filaments may be laminated onto a web produced according to the above-mentioned "process for continuously fixing arrangement of yarns" (Japanese patent No. 835,956) which web is composed of usual yarns as warps and filaments consisting of a hot-melt adhesive as wefts. The resulting laminate web is easy to wind up. In addition, if this laminate web is secondarily further laminated onto another non-woven fabric or a web of warped yarns, the hot-melt adhesive already applied can again serve for bonding; this brings about a more convenience.

In the case of the weft web of ejected filaments produced according to the process of the present invention, it is possible to choice the take-up velocity within a broader range, as compared with the weft web of ejected filaments obtained by first adhering the ejected filaments arranged in parallel, onto selvage materials and then taking up the resulting web, by the guidance of the selvage materials, whereby it is possible to readily obtain a product having a larger weight per unit area. The web can be regularly stacked on the surface of a belt running in the lateral direction below the spinning head, and also it is possible to optionally adjust the moving velocity of the belt surface independently of the amount of filaments spun from the spinning head. Accordingly, in order to increase the weight of the product per unit area even when the amount of filaments spun from the spinning head is constant, the moving velocity of the belt surface therebelow may be reduced. Whereas in the case where the ejected filaments arranged in parallel are first adhered onto selvage materials and the resulting web is taken up by the guidance of the selvage materials, as mentioned above, it is impossible to make the take-up velocity so low, since adjacent filaments overlap at such a low velocity; hence the cross-laminated products using the weft web of ejected filaments obtained according to the process of the present invention, if the weight of the warp web per unit area is adequately selected, may have sufficient strengths, as they are, and can be utilized as materials for packing or making bags or other industrial products. This is one of the important specific features of the present invention.

The most important uses of the weft web of ejected filaments as product, obtained according to the process of the present invention are for example as follows: the above web including a web obtained by further stretching a weft web of ejected filaments in the lateral direction to increase the strength of single filaments therein, is laminated onto a web of yarns or filaments arranged in parallel as warps, e.g. a web of warped yarns or a web of filaments arranged in parallel, having a uniform thickness, obtained by extending filament tow in the lateral direction, and the resulting laminated web is used as reinforcing materials for various films, sheets, non-woven fabrics, etc., or is, as it is, used as various packaging materials, bag materials, etc. when it has adequate weights per unit area in the warp and weft directions. Further, the weft web of ejected filaments may also be, as it is, or, in the form of a material having a few sheets thereof placed on each other, used as reinforcing materials for commercially available papers, films, non-woven fabrics as random webs, etc. when improvement of the strength in the weft direction is particularly required for these products. In the production of such products, it is necessary in almost all cases that the weft web of ejected filaments as product or a product obtained by further stretching the above web in the lateral direction be subjected to heat set to improve their dimensional stability.

As the raw material polymer for the ejected filaments used in the process of the present invention, thermoplastic polymers are mainly used and polymers having a filament-forming property are particularly used. Examples of such polymers are linear polyolefins such as polypropylene, high density polyethylene, nylons such as 6-nylon, 6,6-nylon, polyesters such as PET, polyvinylidene chloride, etc. Besides, polyvinyl alcohol, polyacrylonitrile, etc. may also be used. In this case, however, wet spinning is carried out using such polymers and a coagulation bath is substituted for the above mentioned cooling liquid. Further it is possible in some cases to use the so-called hot-melt sizing agents as the raw material resin, because when the resulting web obtained by using such agents is placed between two sheets to adhere them together, it is possible to reduce the weight of sizing agent per unit area and also ensure a uniform adhesion.

Next, the present invention will be described referring to the accompanying drawings.

Figure 2:
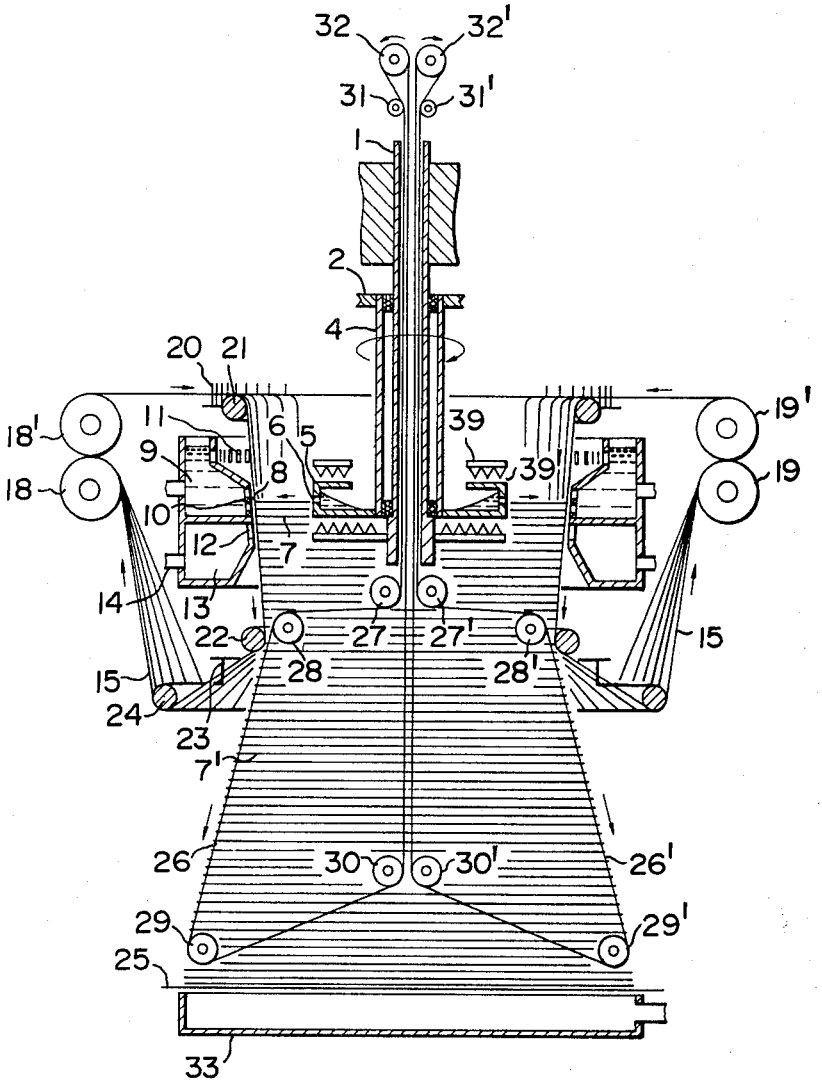
FIG. 2 shows a vertical side cross-sectional view of the apparatus projected on a plane that is rectangular to the section shown in FIG. 1, passing through the central axis of the spinning head.
Figure 3:
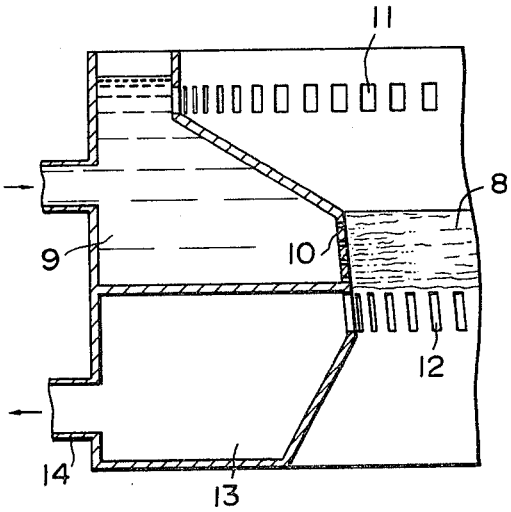
FIG. 3 shows a cross-sectional view of a wall surface totally wetted with a liquid by the surface of which the ejected filaments are caught, and a suction chamber provided just below the location where the filaments are caught.

In FIG. 1 and FIG. 2, filaments 7 are centrifugally ejected from the spinning nozzles 6 of a spinning head 5 fixed onto a shaft 4 supported by a sufficiently thick hollow shaft 1 fixed onto a frame at its upper part and rotating at a high velocity by the medium of a pulley 2 driven by a belt 3. When the filaments 7 reach a liquid surface as a catching surface for the filaments, on a wall surface 8 wetted by the liquid over the total surface thereof, they are cooled and solidified. The above wall surface 8 is, as shown in detail in FIG. 3, provided with a reservoir 9 for a cooling liquid into which the liquid is fed so as to always maintain a constant annular level of the liquid, behind the wall surface, and the cooling liquid is sufficiently fed to the wall surface 8 through a perforated plate 10 just behind the wall surface 8; at the same time, a cooling liquid of the same kind as the above is caused to flow out of slits 11 for causing cooling liquid to flow out, additionally provided above the wall surface 8, to form a catching liquid surface consisting of the cooling liquid uniformly flowing down on the wall surface 8. Slit-like suction holes 12 spaced at closest intervals are provided just below the lower end of the wall surface 8 down to which end the ejected filaments come, and the cooling liquid is sucked together with the ambient air into a suction chamber 13 behind the suction holes 12. The suction chamber is connected via a pipe 14 with a Nash pump for suction (not shown).

A plurality of guides 15 are divided into four equal portions and these are all driven at the same velocity by means of 4 sets of pinch rolls 16, 16'; 17, 17'; 18, 18'and 19, 19' located right and left and in front and in rear. They are passed through the respective annular combs 20 by which their locations are determined, and then through the respective annular guide bars 21 by which their directions are turned; they come down toward the wall surface 8; and they move downwards while passing through the inside of the cooling liquid. They pass then through over the slit-like suction holes 12, and further through the respective annular guide bars 22 located below the suction chamber 13, the annular combs 23 and the annular guide bars 24 and returned to the respective pinch rolls to effect circulation.

Filaments 7 centrifugally ejected from the spinning nozzles 6 of the spinning head 5 reach the liquid surface on the wall surface 8 where they are caught by the flowing down liquid and flow down. Just thereafter they reach the slit-like suction holes 12 located just therebelow where they are separated from the cooling liquid and transferred onto the circulating plurality of guides 15 after having passed through the inside of the liquid, by which guides they are carried downwards. At that time, as shown in FIG. 2, the ejected filaments 7 in a cylindrical form are successively extended toward the width direction of the circulating belt 25 running therebelow, by a pair of right and left guides 26, 26' provided inside the cylindrical ejected filaments 7 and circulating almost perpendicularly to the running direction of the circulating belt 25, and dropped on the circulating belt 25 in a long-ellipse form. The pair of right and left guides 26, 26' are, as shown in FIG. 2, passed respectively through pulleys 27, 27'; 28, 28'; 29, 29'; and 30, 30' and further through the hollow shaft 1 and led to the outside of the apparatus, and then driven by pulleys 31, 32 and 31', 32' in the directions of arrow marks, respectively, to effect circulation. Thus the ejected filaments 7' in a circular form turn to those in a long-ellipse form, which are then sent toward the direction of an arrow mark while they are stacked on the circulating belt 25 therebelow. The circulating belt may be preferably of a metal gauze, and if a suction chamber 33 is provided on the back side of the belt surface on which the ejected filaments are stacked, the ejected filaments 7 can be caught on the belt 25 with certainty. Close to the tip end of the circulating belt 25 on the advancing side thereof is provided a guide plate 34 where both the right and left selvage end parts of the stacked ejected filaments are sewn by machines 35, 35', respectively. The resulting sewn ejected filaments are transferred onto a second circulating belt 36 for taking up them, and the selvage end parts are extended toward right and left by cross-guiders 37, 37'. The resulting almost straight form ejected filaments are sent to the subsequent step.

The supply of a polymer into the spinning head 5 is carried out through a feeding pipe 38 connected to an extruder or a gear pump (not shown), the polymer being in molten state or in the form of a concentrated dope. In the case of molten polymer, an innert gas may be advantageously blown into the upper part of the spinning head 5 to avoid its deterioration due to its contact with the ambient air. The spinning head 5 is electrically heated by heaters 39, 39' located above and below the head. The supply of electricity to the lower heater 39' is carried out through the fixed hollow shaft 1. In addition, a guide 40 may be provided which is a fixing guide applied to the ejected filaments from the inside thereof.

Next, a method of collecting the ejected filaments in the form of multifilaments will be described below. In FIG. 1, the above-mentioned sewing machines 35, 35' above the guide plate 34 are replaced by a means by which a tape having a hot-melt adhesive applied thereonto is applied onto the ejected filaments stacked in the form of a band on both the upper and lower surfaces thereof, and the tape with a hot-melt adhesive is adhered straightly in the weft direction onto both the upper and lower surfaces of the ejected filaments, in each definite length of the filaments, followed by cutting the band of the ejected filaments together with the tape. The respective ejected filaments in the form of a band, cut in each definite length are encased in separate cans. The ejected filaments are then drawn upwards out of the respective cans, starting from the rear end of the filaments, by the guidance of the tape adhered onto the filaments, noting the rift of the array of the filaments as a mark, as mentioned above. At the time of the drawing up, the arrangement of filaments may be disturbed in the vicinity of the initial tape, but if the filaments are drawn upwards at a sufficient distance therefrom, it is possible to take out the ejected filaments in the form of multifilament yarns orderly arranged and having a filament number equal to the number of the spinning nozzles of the spinning head; thus the resulting material is wound up in a manner according to its uses.

Figure 5:
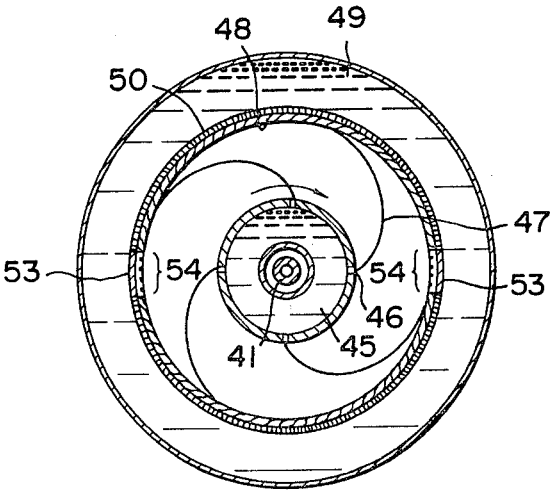
FIG. 4 and FIG. 5 show a case where warp selvage materials are in advance inserted into the inside of the liquid, respectively.
Figure 4:
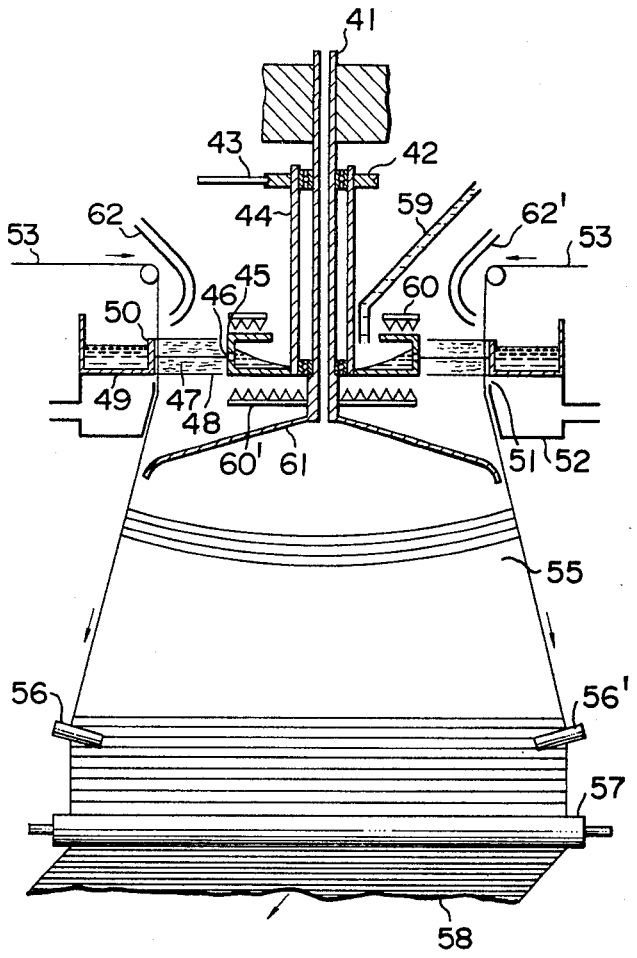

In FIG. 4 and FIG. 5, filaments 47 are centrifugally ejected from the spinning nozzles 46 of a spinning head 45 fixed onto a shaft 44 supported via a bearing by a hollow shaft 41 fixed onto a frame at its upper part and rotating at a high velocity by the medium of a pulley 42 driven by a belt 43. When the filaments reach a fixed, annular, wetted wall surface 48 consisting of a cloth, as a catching part for the filaments, they are cooled, solidified and caught by the surface. Behind the wetted wall surface 48 is provided an annular reservoir 49 for a cooling liquid, from which the cooling liquid is sufficiently fed to the wetted wall surface through a perforated plate 50 located just behind the wetted wall surface.

Just below the location where the ejected filaments reach the wetted wall suface 48 are provided slit-like suction parts 51 spaced at closest intervals, and just behind these parts is provided a negative pressure-suction chamber 52, to suck the ambient air around the spinning head together with the cooling liquid.

Warp selvage materials 53 having adhesive properties are fed from thereabove and led downwards while passing through the respective parts 54 onto which the warp selvage materials are adhered and which are placed between the wetted wall surface 48 on the right and left sides of the parts (see FIG. 5). Just behind the parts 54 is provided no hole through which the cooling liquid passes; hence the warp selvage materials are neither wetted nor cooled. The ejected filaments 47 adhere onto the warp selvage materials 53 passing through such parts 54 and advance downwards while they are led by the selvage materials. The weft web 55 of ejected filaments, adhered onto the warp selvage materials, is extended toward right and left together with the selvage materials 53 by cross-guiders 56, 56' to form a flat, two-ply sheet, which is then passed through a turn roll 57 and taken up in the form of a two-ply weft web 58 of ejected filaments.

The supply of a molten polymer into the spinning head 45 is carried out through a feeding pipe 59. At that time, in order to avoid contact of the molten polymer with the ambient air, an innert gas may be blown into the upper part of the spinning head. The spinning head 45 is electrically heated by heaters 60, 60' located above and below. The supply of electricity to the lower heater 60' is carried out through the hollow shaft 41. If necessary, it is possible to provide a guider 61 for the weft web 55 of ejected filaments, supported by the fixed hollow shaft 41. Further it is also possible to insert additional selvage materials into the inside of the weft web 55 through the guider 61 and take up these materials together with the weft web of ejected filaments.

If necessary, it is possible to supply heated air through pipes 62, 62' to the parts 54 onto which the warp selvage materials are adhered, to thereby heat the warp selvage materials, or to provide heaters behind the parts 54 to thereby heat the warp selvage materials, whereby the adhesive properties of the materials are improved.

The present invention will be further described by way of Examples.

EXAMPLE 1

In this Example, the apparatus shown in FIG. 1 and FIG. 2 was employed. A molten polyester (PET) was fed at a rate of 670 g per min. into a cylindrical spinning head having a diameter of 400 mm on the periphery on which spinning nozzles are located, and rotating at a velocity of 2,000 r.p.m. and maintained at 280° C. by heating, and ejected from 120 spinning nozzles of 1 mm in diameter consisting of two groups, each group having 60 spinning nozzles spaced at equal intervals on the periphery of the spinning head and the distance between the two groups being 50 mm. The ejected filaments were for a time caught by the liquid surface of water flowing down along a wall surface covered by a cloth surface of 600 mm in diameter at the lower end thereof wetted by cooling water over the total surface, concentrically provided around the spinning head, and having a cross-sectional structure as shown in FIG. 3. When the cooling water was sucked together with the ambient air into a suction chamber just therebelow through suction slits thereof, the above caught ejected filaments were separated from the cooling water and at the same time transferred onto guides of nylon tire cords of 840 deniers arranged at a pitch of 20 mm, running downwards while passing through the inside of the cooling water. The guides were circulated at a velocity of 2 m per second. A pair of circulating belts provided inside the annular ejected filaments and consisting of a polyurethane round belt of 2 mm in diameter were circulated at a velocity of 2 m per second same as that of the outside tire cords.

The ejected filaments were dropped on a circulating belt of a metal gauze running at a velocity of 20 m/min. in the lateral direction, in the form of a long-ellipse elongated laterally to the advance direction of the belt. The ejected filaments moved in the lateral direction at a velocity of 20 m/min., while they were stacked on the circulating belt in the form of a band having a width of about 800 mm.

An adhesive tape of 25 mm in width was then applied onto the band-form ejected filaments on both the surface and back surface thereof, straightly across the band-form filaments, every 10 minutes, and the resulting band-form ejected filaments were cut straightly in the lateral direction together with the adhesive tapes. Each cut piece thus obtained was encased in separate cans. Two groups of the filaments were drawn out of the respective cans upwards from their rear ends, under the guidance of the adhesive tapes adhered onto the band-form ejected filaments, noting the rifts of the array of the ejected filaments as a mark, to obtain about 370,000 m of multifilament yarns of about 1600 deniers, from each can. These yarns were subjected to after-stretching to 1.5 times, followed by heat-set treatment, to obtain about 540,000 m of multifilaments of about 1100 deniers in thickness, which were then wound up on four separate bobbins. Each single filament of the resulting yarns had a thickness of about 9 deniers and a strength of 5.0 to 5 g/d.

EXAMPLE 2

Polyester ejected filaments were produced in the same manner as in Example 1 except that the ejected filaments were taken up in the form of a band of about 800 mm in width at a running velocity of the metal gauze belt of 12 m/min. and both the selvage end parts thereof were machine-sewn with cotton yarns of count No. 30, followed by extending both the selvage end parts toward the lateral direction so as to make the ejected filaments nearly straight, while pinching both the selvage end parts by cross-guiders, to obtain a band-form web of 930 mm in width. This web was subjected to after-stretching to 1.5 times in the lateral direction by means of an apparatus for laterally stretching the web, directly connected to the line of the web preparation, followed by heat-set treatment, to obtain a web of about 1.4 in width, having a weight per unit area of 40 g/m$^2$.

Separately, the multifilament yarns obtained in Example 1 were respectively warped into 2,200 ends of 1.3 m in width to obtain two warp webs. Between these two warp webs was placed the weft web of ejected filaments obtained above, having a width of 1.4 m, followed by spraying with a curable acrylic ester emulsion adhesive and then heat contact bonding, to obtain a laminate having a weight of the ejected filaments (total of warps and wefts) per unit area, of about 80 g/m$^2$, a weight of the adhesive of about 20 g/m$^2$ and strengths of 90 to 100 Kg per 5 mm in width in both warps and wefts.

EXAMPLE 3

A melt of a polypropylene for fiber use extruded from an extruder in a definite amount was fed into a cylindrical spinning head of 300 mm in diameter maintained at 280° C. and rotating at 2,000 r.p.m., the head having 100 spinning nozzles on the outer periphery, and filaments were centrifugally ejected from the nozzles onto a short annular wetted wall surface consisting of a cloth surface having a height of 30 mm and an inner peripheral length of 1,540 mm, onto which cooling water was oozing out in a sufficient amount. Two sets of hot melt adhesive-applied warp selvage materials were passed through the respective parts where the warp selvage materials were to be adhered, at the respective two symmetrical locations of the above short annular surface, at a velocity of 40 m/min. Each of the above two sets of warp selvage materials consisted of two stripes arranged at an interval of 2 mm, each one stripe of which was obtained by arranging 7 ends of cotton yarns of count No. 20 at a pitch of 1 mm and sizing them with an ethylene-vinyl acetate copolymer hot-melt adhesive.

The parts where the warp selvage materials were to be adhered and through which the materials were passed were always kept so that the parts were not contacted with the cooling water, and hot air was blown to the parts so that the hot-melt adhesive always maintained adequate adhesive properties.

The filaments ejected from the spinning head were cooled and solidified simultaneously with their arrival at the wetted wall surface, and then shifted from the wetted wall surface by the negative pressure suction force through suction slits exerted just below the wetted wall surface. At the same time, with the movement of the adhesive-applied warp selvage materials which were adhered onto the parts where the materials were to be adhered and then began to be cooled and solidified by the suction air at the negative pressure suction parts, the filaments adhered onto the annular negative pressure suction parts were peeled off. Further, with the downward movement of the annular form weft web of ejected filaments, the web was flattened while the warp selvage materials were extended toward right and left by cross-guiders, to take up a flat two-ply web. This web was then pinched by a grip tenter at both the selvage ends and stretched to 4 times in the lateral direction in heated hot air, followed by heat set as it was, to obtain a weft web of ejected filaments having a length of filaments between both the selvage ends, of 2,700 mm, a thickness of filaments of 10 deniers, strengths of 4.0 to 5.0 g/d and elongations of 25 to 30%. The weight per unit area of the weft web of ejected filaments in the state where the filaments were drawn in the weft direction was about 11 g/m$^2$. In this case, when both the selvage ends of the above two-ply web taken up were subjected to machine-sewing in advance of the stretching in the lateral direction, a smooth operation was possible at the time of the subsequent stretching in the lateral direction.

What is claimed is:

1. In a process for producing a plurality of continuous synthetic organic polymer filaments by centrifugally and horizontally ejecting liquid polymer from a plurality of nozzles of a head rotating at high velicity, the improvement which comprises obtaining a plurality of filaments of uniform thickness by (a) establishing an annular curtain of downwardly flowing water at a spaced distance laterally outwardly from said nozzles, (b) catching and cooling the centrifugally ejected continuous molten synthetic organic polymer filaments by impinging them against said annular curtain of downardly flowing water, and allowing said filaments to move downwardly with the downwardly flowing water in said annular curtain, (c) separating said ejected filaments from said annular water curtain after said filaments have been cooled by said water, and (d) collecting cooled and separated continuous filaments of synthetic organic polymers that have uniform thickness.

2. A process according to claim 1 wherein said annular curtain of downwardly flowing water is formed by water flowing evenly and without turbulence downwardly over a solid surface that is disposed annularly around said rotating nozzles.

3. A process according to claim 1 wherein said cooled ejected filaments are also moved downwardly by contacting said cooled filaments with downwardly moving solid guide means.

4. A process according to claim 3 wherein said solid guide means moves downwardly through said annular curtain of downwardly flowing water.

5. A process according to claim 3 wherein said cooled ejected filaments are also guided in their downward movement by a stationary guide means.

6. A process according to claim 3 wherein said guide means comprise a plurality of cords.

7. A process according to claim 1 wherein separation in step (c) is effected by suction.

8. A process according to claim 1 wherein in step (d) the filaments are collected on the surface of a belt running in a lateral direction below the rotating head.

9. A process according to claim 1 wherein selvage material is applied onto both the side end parts of the ejected filaments and then taking up the filaments in the form of a web of ejected filaments arranged in parallel as wefts.

10. A process according to claim 2 wherein said solid surface is a hydrophilic cloth.

11. A process according to claim 1 wherein the diameter of said annular curtain decreases in a downwardly direction.

12. A process according to claim 3 wherein said guide means comprises adhesive warp selvage material that passes downwardly through the inside of said annular curtain but very close to the surface thereof and extends downwardly below said annular curtain.

* * * * *